United States Patent [19]

Hippely et al.

[11] Patent Number: 4,575,350

[45] Date of Patent: Mar. 11, 1986

[54] TRACK FOR TOY VEHICLES

[75] Inventors: Keith A. Hippely, Manhattan Beach; Philip W. Crain, Rancho Palos Verdes, both of Calif.

[73] Assignee: Mattel, Inc., Hawthorne, Calif.

[21] Appl. No.: 571,025

[22] Filed: Jan. 16, 1984

[51] Int. Cl.[4] ..... A63H 3/00; A63H 18/00

[52] U.S. Cl. ..... 446/368; 446/444; 238/10 A

[58] Field of Search ..... 446/168, 268, 368, 431, 446/429, 430, 444–447, 478, 491, 304; 273/86 B, 86 C; 238/10 R, 10 A, 10 E, 10 F; D21/143

[56] References Cited

U.S. PATENT DOCUMENTS

| | | | |
|---|---|---|---|
| 3,735,923 | 5/1973 | Brigham et al. | 238/10 E |
| 3,750,945 | 8/1973 | Warr | 238/10 E |
| 3,780,235 | 12/1973 | Deyerl et al. | 238/10 F X |
| 4,094,508 | 6/1978 | Kirsch | 273/118 |
| 4,254,907 | 3/1981 | Pine | 238/14 |
| 4,257,610 | 3/1981 | Ptaszek et al. | 446/304 X |

*Primary Examiner*—Mickey Yu

*Attorney, Agent, or Firm*—Ronald M. Goldman; Melvin A. Klein; Daniel F. Sullivan

[57] ABSTRACT

A toy track (10) in the shape of a snake for use with a toy vehicle (38). The track has a tail end (12) and a head (24). The head including a top section (26) and a bottom section (28) having a mouth formed therebetween with a coiled tongue (30) therein. When a toy vehicle traveling along the track enters the head from the back, the vehicle will be allowed to exit through the mouth of the head if it has sufficient energy to completely unroll the tongue. However, if the vehicle does not have sufficient energy, the tongue will not completely unroll and will be retracted back into the mouth, to its normal rest position, pulling the toy vehicle with it.

21 Claims, 6 Drawing Figures

10
12
14
16
18
20
22
24
26
28
30
32
34
36
38
3

TRACK FOR TOY VEHICLES

TECHNICAL FIELD

This invention relates to tracks for use with toy vehicles, and more particularly to a specifically shaped track for gravity powered toy vehicles.

BACKGROUND

Toy vehicle tracks of many types are known. These include toy vehicle tracks incorporating flexible track sections, such as that developed by Mattel, Inc., the assignee of the present invention, and disclosed in pending U.S. patent application Ser. No. 434,815, filed Oct. 18, 1982. In this application, there are provided flexible track sections having a number of interconnecting segments. The interconnections are provided by a first section which mates with or is connected to a second section. Both sections have planes or portions formed of somewhat resilient material to permit flexing of the planar sections and both the bottom and the side walls of the track sections are configured to overlap to thereby prevent aberrations or the like so as to eliminate vehicle bouncing during travel of gravity-powered vehicles along the track.

U.S. Pat. No, 4,094,508, filed June 13, 1978, discloses a combination type game having a base on which is mounted a transparent tube which may be formed in an asthetically pleasing coil shape. A mouth piece is attached to the tube. A pipe bowl is positioned along the tube and is in communication with the interior of the tube. A lightweight ball is mounted in and capable of moving within the tube by a smoker drawing smoke through the tube to advance the ball to a predetermined position within the tube. In another embodiment, the device is adapted to be used by two or more smokers by inserting a fitting having the appropriate number of outlets and smoking tubes connected to these outlets.

U.S. Pat. No. 4,254,907, issued Mar. 10, 1981, is drawn to an improved portable traction track for a vehicle driving wheel, and has plurality of eight sections flexibly connected to one another to form an elongate strip adapted to be pulled under a rotating drive wheel. Each of the base sections include transversely spaced vertical side walls which have longitudinally spaced edges disposed in predetermined angular relationship to edges of the immediately adjacent side walls in a decreasing angular relationship from the front toward the rear of the strip. The edges of the side walls are also provided with locking features such that upon flexing of the base sections in one direction, the side sections engage one another to permit only a predetermined amount of flexing of that portion of the strip. This disclosure provides a construction giving a bridge effect as a wheel of a vehicle rotates and pulls the strip under the wheel to the point that the vehicle is driven out of a rut or the like in which it might be stuck.

None of the above set forth prior art, however, discloses a toy vehicle track of the type set forth in the present application, in which the track includes a beginning and an end, shaped in the form of an animal or the like. And, in which a toy vehicle running along the track may exit from the track through the head to simulate a vehicle traveling along the animal's body and emerging from the animal's mouth.

DISCLOSURE OF THE INVENTION

In accordance with one embodiment of the present invention, there is provided a toy track in the shape of a snake for use with a toy vehicle. The track has a tail end and a head. The head comprises a top section and a bottom section forming a mouth therebetween with a coiled tongue therein. When a toy vehicle traveling along the track enters the head from the back, the vehicle will be allowed to exit through the mouth of the head if it has sufficient energy to completely unroll the tongue. However, if the vehicle does not have sufficient energy, the tongue will not completely unroll and will be retracted back into the mouth, to its normal rest position, pulling the toy vehicle with it.

BRIEF DESCRIPTION OF THE DRAWINGS

Further objects, features, and advantages of the invention will become apparent upon a reading of the specification when taken in conjunction with the drawings in which like reference numerals refer to like elements in the several views.

BEST MODE FOR CARRYING OUT THE INVENTION

Figures 1, 2:
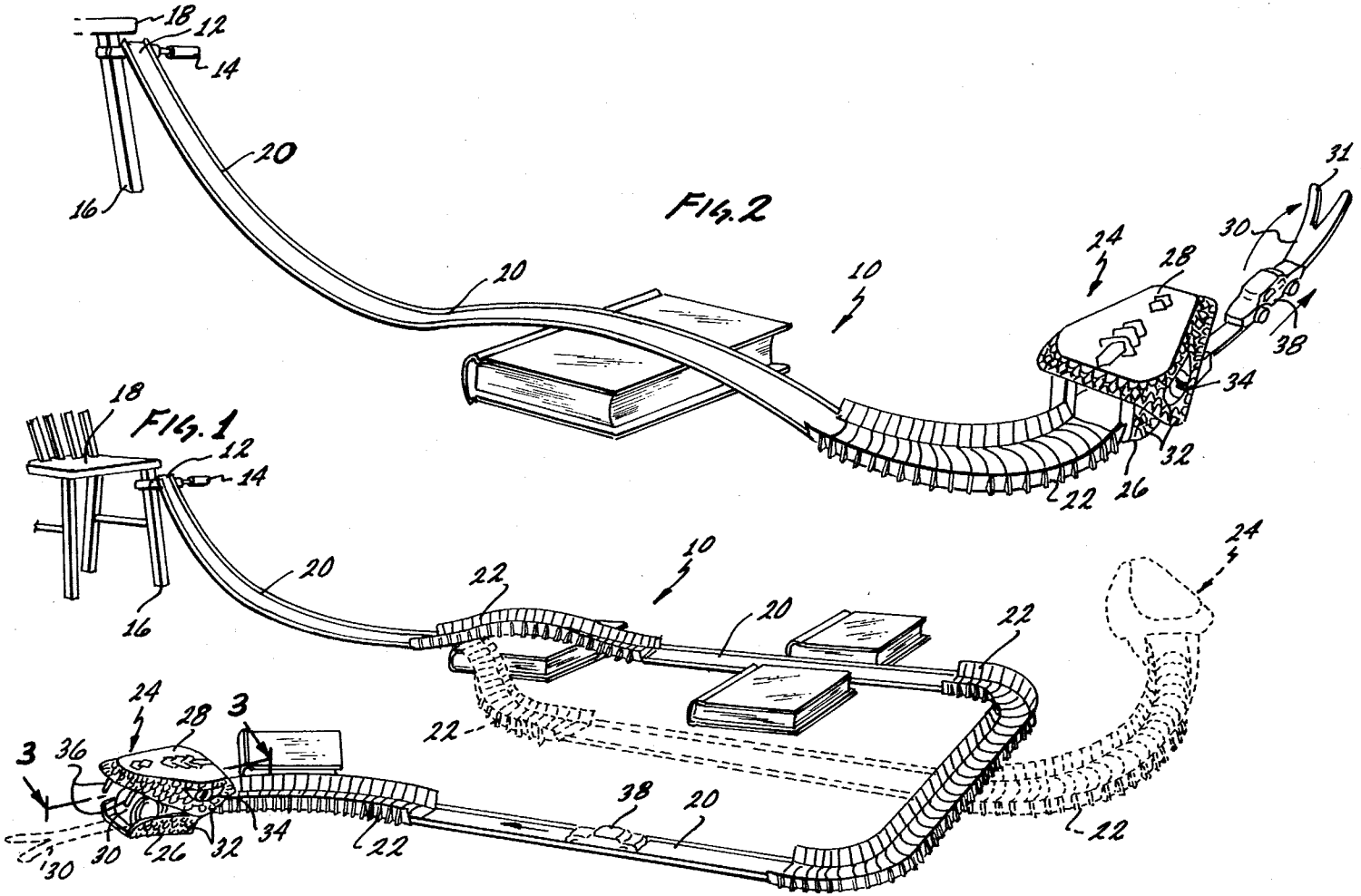
FIG. 1 shows a perspective view of the toy track of the present invention, having the tail end thereof fixed in an elevated position to a chair with the intervening track sections and head of the track shown in various positions.
FIG. 2 is further perspective view of the track of the present invention in a different position, and with a toy vehicle exiting from the head.
Figure 4:
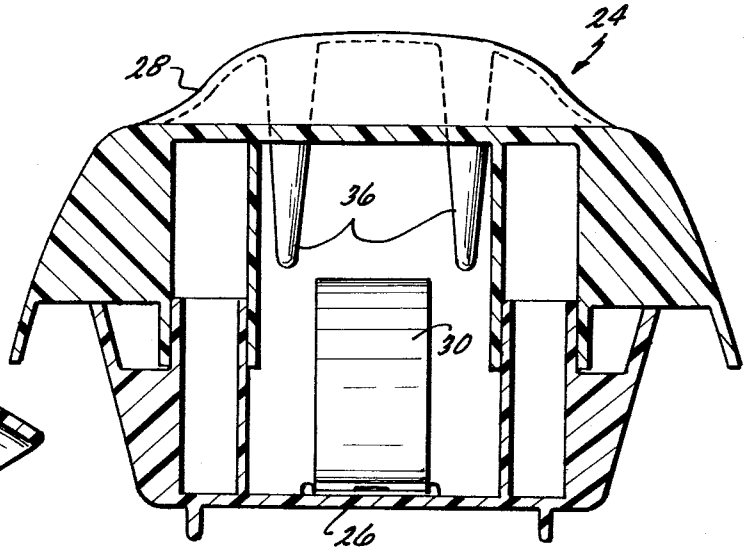
FIG. 4 is a cross-sectional view of the head taken along line 4—4 of FIG. 3.

Referring now to the drawings, and particularly to FIGS. 1 and 2, there shown is a toy track 10 in accordance with the present invention. The toy track includes a beginning or tail 12 which may rest on a floor, or which may be fixed in an elevated position, above the floor, by any appropriate means, such as a clamp 14 attached to the bottom of the tail 12 and fixed to a leg 16 of a chair 18. The tail 12 comprises part of a substantially straight extruded track section 20, a plurality of which may be used within the toy track. These straight track sections may be fixed to other straight sections, or may be fixed together by a plurality of flexible track sections 22 of the type disclosed in copending U.S. patent application Ser. No. 434,815, to form a body, of any desired length, of an animal, a snake, or the like. As shown in solid line in FIGS. 1 and 2, and broken line in FIG. 1, the flexible sections 22 allow the body of the snake to be moved to various positions for different play situations.

Figure 3:
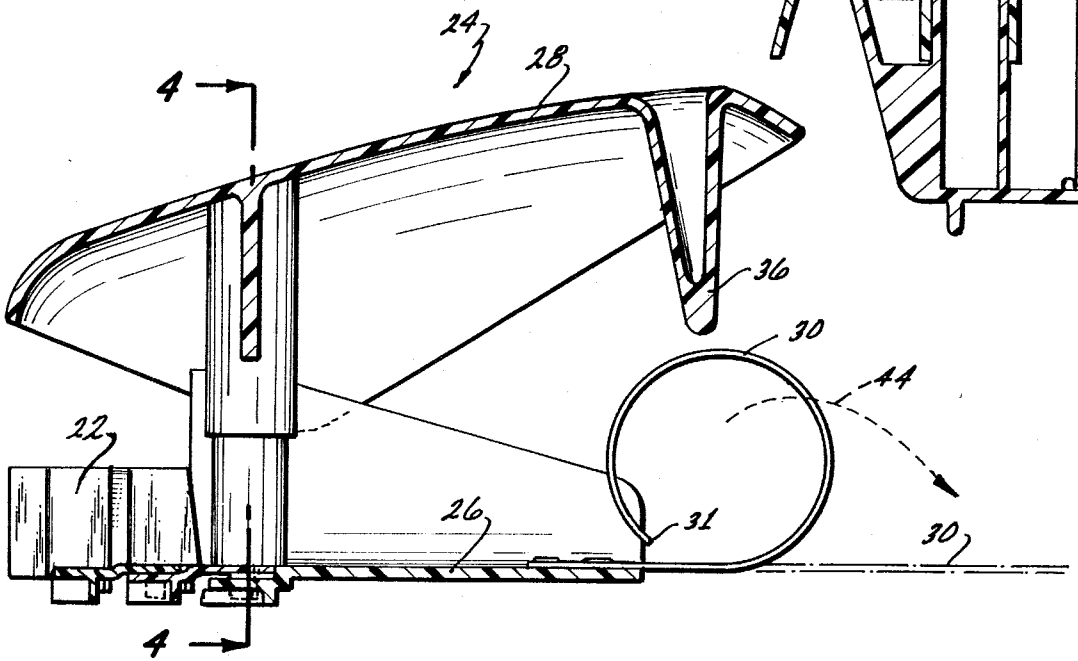
FIG. 3 is a cross-sectional view of the head taken along line 3—3 of FIG. 1.
Figure 5:
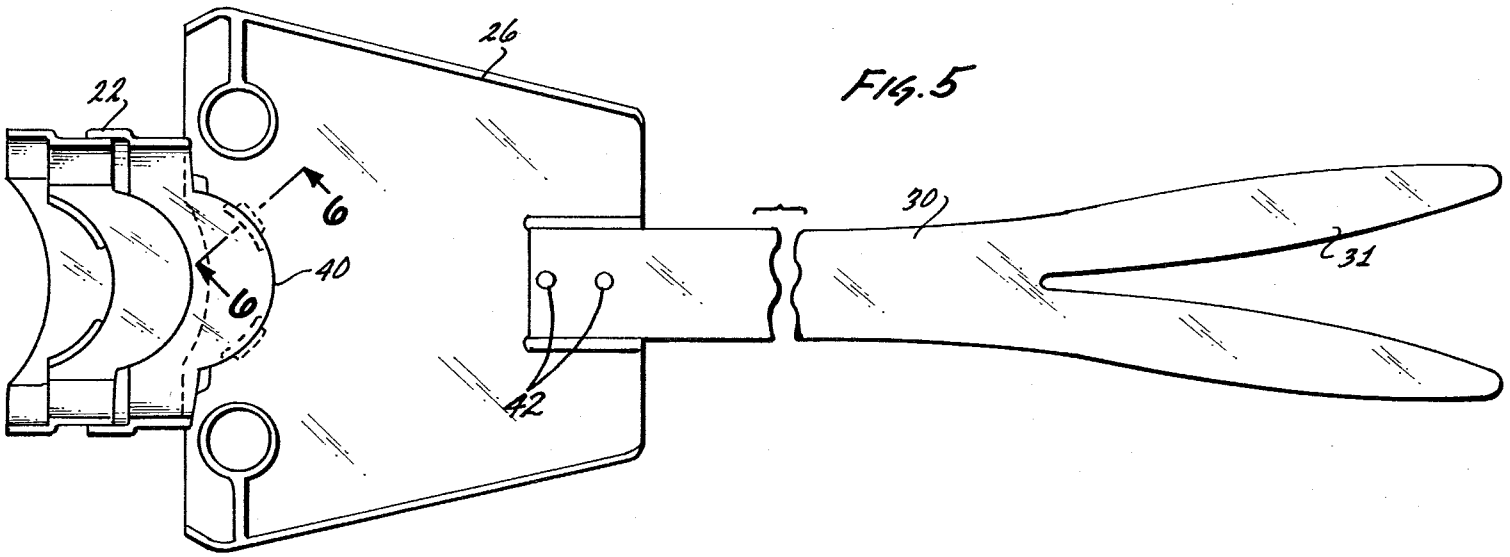
FIG. 5 is a top plan view of the bottom half of the head showing the attachment to the end of a flexible section of track, and with a tongue extending outwardly in the full open position.
Figure 6:
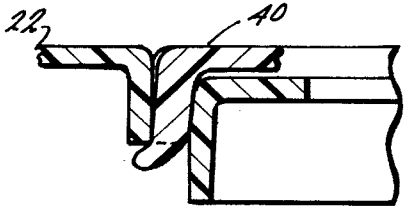
FIG. 6 is a cross-sectional view taken along line 6—6 of FIG. 5.

Separated from the beginning or tail end 12, by any desired number of fitted together track sections 20, 22, is a head 24 adapted to be fixed to the free end of a flexible track section 22, as shown more clearly in FIGS. 3 and 5. Head 24 includes a bottom portion or section 26 and a top portion or section 28, forming a mouth therebetween. In the preferred embodiment shown, the head is shaped as a snake's head, for example a cobra. A coiled or rolled up tongue 30, has its inner end securely held or fixed to the bottom section, with the outer or forked end 31 being free and in coiled position above the fixed end. The tongue is normally coiled or rolled up within the mouth (FIGS. 1 and 3), but may be rolled out or flattened, as shown in solid line in FIGS. 2, and 5, and in broken line in FIGS. 1 and 3, by the action of a toy vehicle, as explained more fully hereinafter.

The exterior of the bottom and top portions 26, 28, of the head 24 may be decorated in any desired manner to provide the required look and feel of the head it is desired to illustrate. For example, the head illustrated in the drawings resembles a cobra, and includes scales 32 and eyes 34. In addition, fangs or teeth 36 may be added in the mouth, for example extending downwardly from the top half 28. The tongue 30 therefore appears to uncurl or roll out of the mouth from between the fangs.

A gravity-powered (non-motorized) vehicle 38, such as the Hot Wheels brand toy vehicles manufactured and sold by Mattel, Inc., are preferably used with the toy track of the present invention. In use, the toy vehicle 38 is started at the tail end 12 of the toy track 10 as by pushing, or by releasing the same from an elevated position. The vehicle races along the track until it reaches the head 24 at the end. The vehicle passes from the end of the last flexible track section, fixed to the rear of the head, at interconnection 40, and passes over the bottom 26 of the head, until it contacts the rolled up tongue 30. The tongue is preferably made from a resilient plastic material, such as mylar, and is formed in the coiled or rolled up position within the head, and held in this position by the natural resilience of the material used and thus formed. The inner end of the tongue is attached to the bottom 26 via pins or other fixing means 42 passing through the inner end and held to the bottom 26. When an approaching vehicle 38 contacts the rolled up tongue, the energy stored in the rolling car (speed) will unroll the tongue, preferably until it reaches the fully extended, flattened out position, as shown in solid line in FIG. 5 and in broken line in FIGS. 1 and 3. That is, if the car strikes or contacts the rolled up tongue 30, as shown in solid line in FIG. 3, with enough energy (speed), the rolled up tongue will uncoil and roll outwardly in the direction of the broken arrow 44 to the flattened position shown in broken line in FIG. 3 and solid line in FIG. 5. This enables the vehicle to exit or pass out completely through the mouth. Thus providing the appearance of a racing vehicle passing along the body of a cobra, as illustrated, and exiting through the mouth. After the vehicle exits, and passes completely over the extended tongue, the tongue will be automatically retracted into the mouth. That is, the tongue will be returned to its coiled or rolled up position by the natural memory or resilience of the material used in the formed tongue.

If the car 38 arriving at the end of the track within the head does not have enough speed (energy) to completely uncoil or unroll the tongue upon contact, the vehicle will be brought to a stop on the partially unrolled tongue, as shown in FIG. 2. The tongue will roll back along itself, into the mouth, thus pulling the toy vehicle with it, through the head, and back onto the track. In this case, it appears as if the toy vehicle is attempting to escape from the cobra's mouth, but has been drawn back into the mouth by the returning tongue.

It therefore, can be seen that a new and novel child's toy track for use with gravity-powered toy vehicles has been provided. The toy track provides the appearance of an animal or a snake, preferably a cobra, having a tail-end and a head. The toy vehicle is made to move along the body between the tail-end and the head and to enter the back of the head so as to exit through the mouth, and over the tongue. Or, the tongue may retract or pull back into the mouth, before the vehicle exits, thereby bringing the toy vehicle back with it.

While there has been shown and described a preferred embodiment of the toy track of the present invention, it is to be understood that there are other adaptations or modifications that may be made within the sphere and scope of the invention as set forth in the attached claims.

We claim:

1. In a toy track for a gravity-powered toy vehicle, a track comprising a beginning and an end connected together by a plurality of sections of track, the sections of track including at least one flexible section, and wherein a head having a top section and a bottom section forming a mouth therebetween is attached to the end of a section of flexible track whereby a toy vehicle traveling along the track must pass through the head between said top and bottom sections to exit from the track.

2. In a toy track for a gravity-powered toy vehicle, a track comprising a beginning and an end connected together by a plurality of sections of track, the sections of track including at least one flexible section, and wherein a head is attached to the end of a section of flexible track, said head including a mouth and a tongue, said tongue unfolding outwardly from the mouth by the action of the toy vehicle passing along the track, through the head and over the tongue, as it exits from the head through the mouth.

3. The toy track of claim 2 wherein the tongue is rolled up within the mouth of the head, with one end of the tongue attached to a bottom section of the head and the other end of the tongue being free and in a coiled position above the fixed end, and whereby the tongue will completely unroll and allow the toy vehicle to exit through the mouth by the action of the toy vehicle passing over the tongue, if the toy vehicle contacts the tongue with sufficient energy, and wherein if the toy vehicle does not have enough energy when it contacts the tongue to overcome the natural resilience of the formed tongue, the tongue will roll back on itself thereby carrying the vehicle with it into the mouth, through the head and back onto the track from which it came.

4. The toy track of claim 3 wherein the coiled tongue is formed from a resilient plastic, such as mylar or the like.

5. The toy track of claim 4 wherein the head has a top and a bottom section fixed together with the mouth formed therebetween, and wherein the bottom forms a continuation of the flexible track section to which it is attached, with the coiled tongue having an inner and outer end.

6. The toy track of claim 5 wherein the outer end of the tongue is forked.

7. The toy track of claim 2 wherein the track is substantially in the shape of a body, of a snake and the head is substantially in the shape of the head of a snake.

8. The toy track of claim 7 wherein the snake's head includes a mouth and a coiled tongue, the coiled tongue capable of being unrolled from the mouth by the action of a toy vehicle passing through the head from the back thereof and over the tongue as it exits from the toy track.

9. The toy track of claim 8 wherein the tongue has two ends, an inner end attached to a bottom sections of the head and an outer end being free and in a coiled position within the mouth above the inner end, and whereby the tongue will be completely unrolled to allow a toy vehicle passing over the same to exit through the mouth by the action of the toy vehicle passing over the tongue, if the car has sufficient energy to overcome the natural resilience of the rolled tongue, and wherein the tongues will roll back on itself, and carry the toy vehicle on the tongue with it back into the mouth and onto the toy track, if the toy vehicle passing over the tongue does not have sufficient energy to completely unroll the tongue.

10. The toy track of claim 9 wherein the coiled tongue is made from a resilient plastic material, such as mylar or the like.

11. The toy track of claim 10 wherein the head is comprised of a bottom section and a toy section affixed over the bottom section to form the mouth therebetween, and wherein the bottom section is a continuation of the toy track.

12. The toy track of claim 11 wherein the outer end of the tongue is forked to give the appearance of the end of a snake's tongue.

13. The toy track of claim 1 wherein the head has a tongue in said mouth, between said top and bottom sections, and wherein the tongue unfolds outwardly from the mouth by the action of the toy vehicle passing through the head and over the tongue, as it exits from the head through the mouth.

14. The toy track of claim 13 wherein the tongue is rolled up within the mouth of the head, with one end of the tongue attached to the bottom section of the head and the other end of the tongue being free and in a coiled position above the fixed end, and whereby the tongue will completely unroll and allow the toy vehicle to exit through the mouth by the action of the toy vehicle passing over the tongue, if the toy vehicle contacts the tongue with sufficient energy, and wherein if the toy vehicle does not have enough energy when it contacts the tongue to overcome the natural resilience of the formed tongue, the tongue will roll back on itself thereby carrying the vehicle with it into the mouth, through the head and back onto the track from which it came.

15. The toy track of claim 14 wherein the coiled tongue is formed from a resilient plastic, such as mylar or the like.

16. The toy track of claim 15 wherein the bottom section of the head forms a continuation of the flexible track section to which it is attached, with the coiled tongue having an inner and outer end.

17. The toy track of claim 16 wherein the outer end of the tongue is forked.

18. The toy track of claim 1 wherein the track is substantially in the shape of a body of a snake, and the head is substantially in the shape of the head of a snake.

19. The toy track of claim 18 wherein the snake's head includes a mouth and a coiled tongue, the coiled tongue capable of being unrolled from the mouth by the action of a toy vehicle passing through the head from the back thereof and over the tongue as it exits from the toy track.

20. The toy track of claim 19 wherein the tongue has two ends, an inner end attached to the bottom section of the head and an outer end being free and in a coiled position within the mouth above the inner end, and whereby the tongue will be completely unrolled to allow a toy vehicle passing over the same to exit through the mouth by the action of the toy vehicle passing over the tongue, if the car has sufficient energy to overcome the natural resilience of the rolled tongue, and wherein the tongue will roll back on itself, and carry the toy vehicle on the tongue with it back into the mouth and onto the toy track, if the toy vehicle passing over the tongue does not have sufficient energy to completely unroll the tongue.

21. The toy track of claim 20 wherein the coiled tongue is made from a resilient plastic material, such as mylar or the like.

* * * * *